United States Patent [19]

Pool

[11] Patent Number: 4,621,587

[45] Date of Patent: Nov. 11, 1986

[54] BOAT CONSTRUCTION

[76] Inventor: Peter J. Pool, 5 Ulladulla Place, Kareela, Sydney, N.S.W., 2232, Australia

[21] Appl. No.: 667,009

[22] Filed: Nov. 1, 1984

[30] Foreign Application Priority Data

Nov. 1, 1983 [AU] Australia ..... 2138/83

[51] Int. Cl.[4] ..... B63H 9/06

[52] U.S. Cl. ..... 114/61; 114/343; 114/347

[58] Field of Search ..... 114/61, 343, 347, 61, 114/270, 39; 441/125

[56] References Cited

U.S. PATENT DOCUMENTS

| | | | |
|---|---|---|---|
| 1,041,679 | 10/1912 | Sargent | 114/347 |
| 1,086,390 | 2/1914 | Miller | 114/347 |
| 1,172,974 | 2/1916 | Frayser | 114/347 |
| 2,339,014 | 1/1944 | Higgins | 114/61 |
| 2,999,253 | 9/1961 | Lewis | 114/347 |
| 3,796,175 | 3/1974 | Ford | 114/61 |
| 3,883,909 | 5/1975 | Fisher | 114/61 |
| 3,986,219 | 10/1976 | Michowski | 114/61 |
| 4,027,614 | 6/1977 | Jones | 114/61 |
| 4,046,091 | 9/1977 | Lomas | 114/61 |
| 4,271,549 | 6/1981 | Chandler | 114/61 |

FOREIGN PATENT DOCUMENTS

| | | | |
|---|---|---|---|
| 8206843 | 10/1983 | France | 114/347 |

*Primary Examiner*—Trygve M. Blix
*Assistant Examiner*—C. T. Bartz

[57] ABSTRACT

A demountable catamaran assembly includes a pair of cockpit-equipped, kayak-type canoe hulls laterally joined in spaced-apart relationship by the frame of a trampoline. Longitudinally spaced pairs of tabernacles on the two hulls removably receive four depending spigot components on the trampoline frame to maintain the assembly of the pair of hulls while a further tabernacle on the trampoline frame removably receives a sail mast.

7 Claims, 7 Drawing Figures

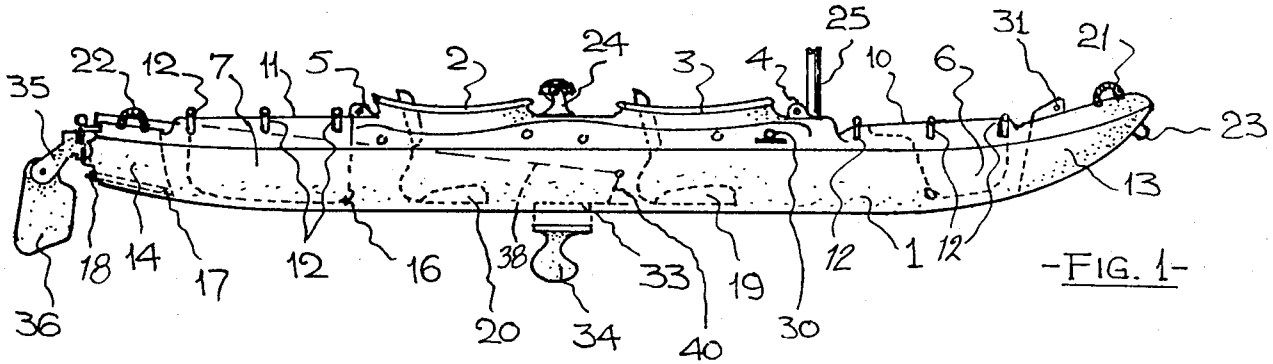
-FIG. 1-
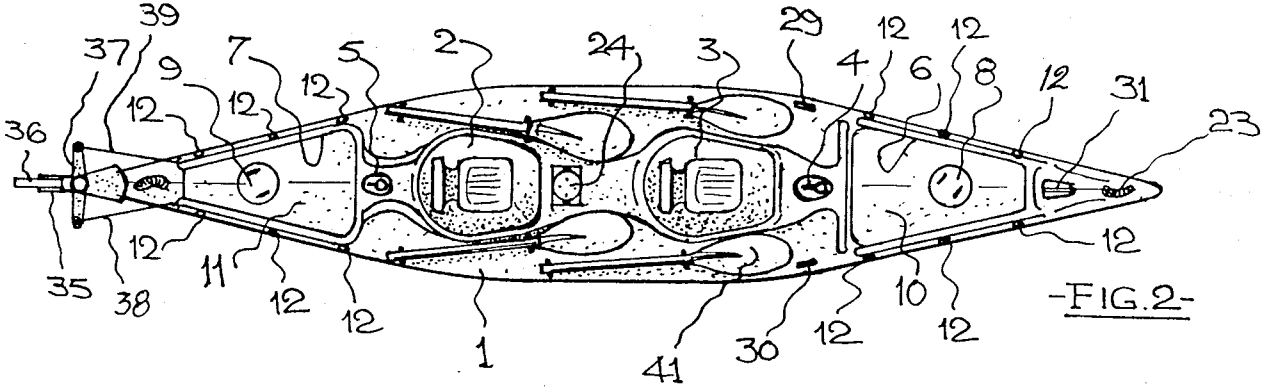
-FIG. 2-

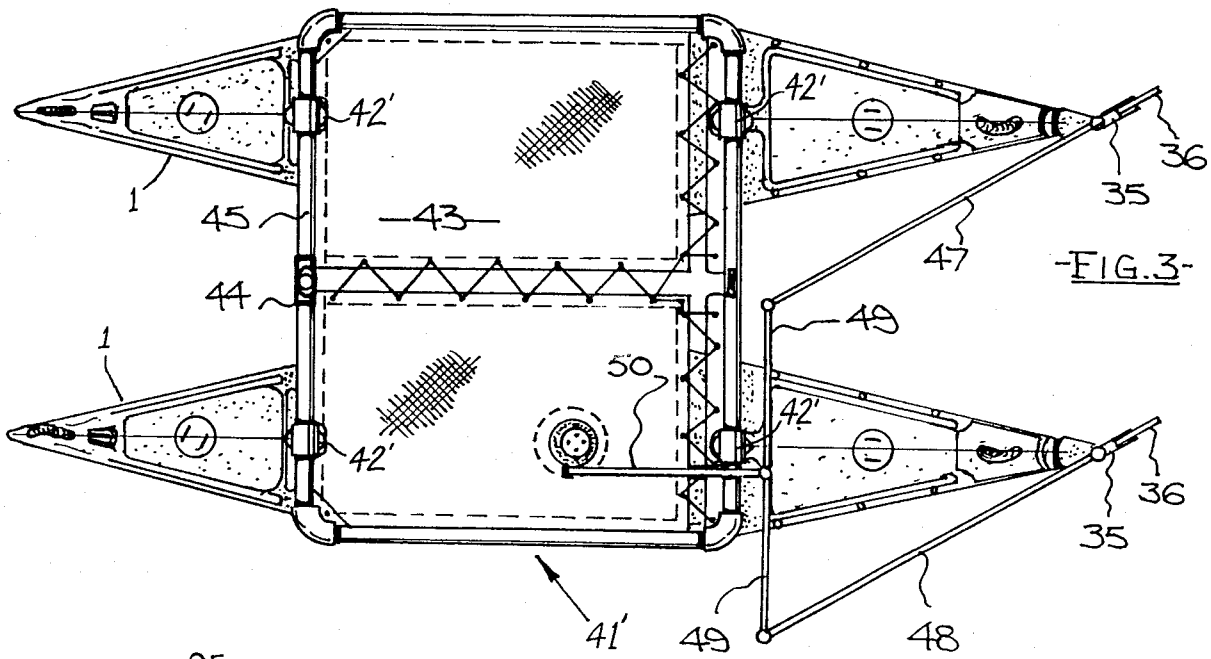
-FIG. 3-
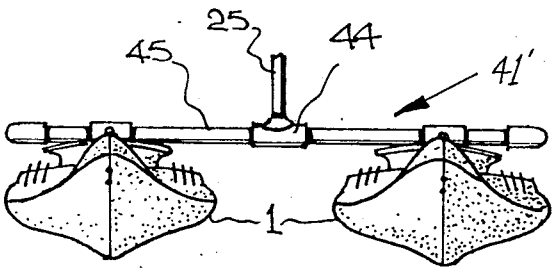
-FIG. 4-

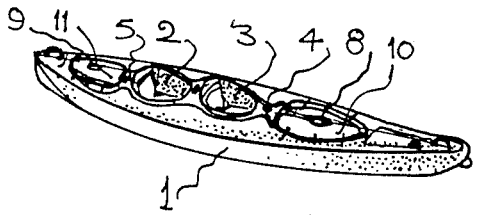
-FIG 5-
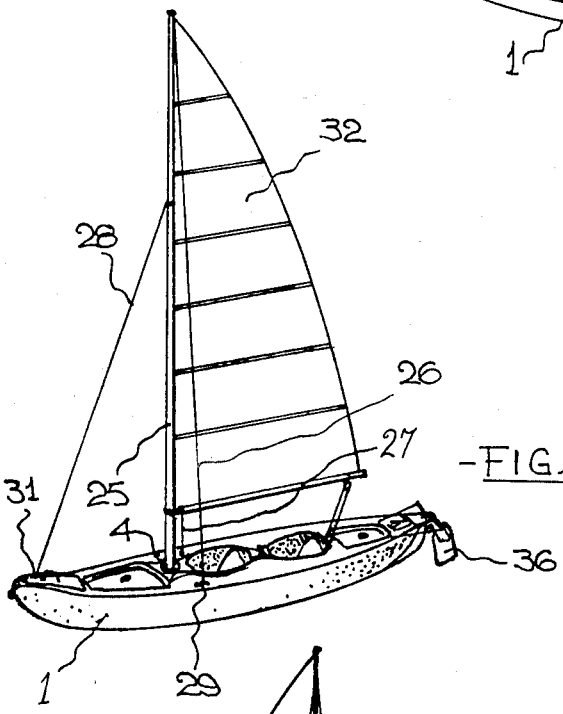
-FIG. 6-
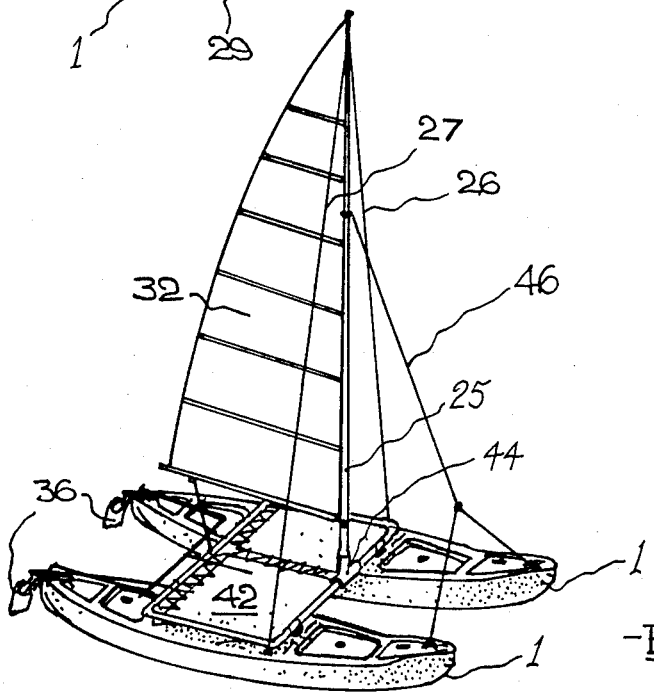
-FIG. 7-

BOAT CONSTRUCTION

This invention relates to boats, and more particularly to a system in which a boat hull is enabled to be converted from a manually-propelled vessel to a sailing vessel, and in which two such boat hulls may be joined together so as to constitute a catamaran.

Canoes and catamarans have a common origin; canoes today are generally narrow-beamed craft, usually manually propelled by paddles rather than oars or sculls and have developed from the simple "dug-out", and the dug-out with laced-on side planks, through birchbark canoes, Eskimo "kayaks" and "umiaks", old Celtic skin-covered "curraghs", to the oceanic "proa", "lakatoi" and "pirogue".

In the Indian and Pacific Oceans, the basic canoe was given one or two outriggers and eventually evolved into the great double-canoe of the Polynesians, which were ocean-going sailing vessels perhaps 120–160 feet long and providing ample living accommodation aboard. Unlike the coast-hugging longships of the Vikings, these double-canoes were capable of voyaging over thousands of miles in the Pacific Ocean.

Today the simple canoe and its descendant the catamaran are sharply demarcated. (The word "catamaran" is derived from a Tamil word meaning "a bundle of logs").

At the present time, one can buy a canoe of the open kind, or of the turtle-decked kayak kind having one or two cockpits. Such a craft is generally limited to use in such bodies of water as rivers or lakes, and perhaps very sheltered bays, as it does not have a keel or centreboard, nor does it possess a rudder. Admittedly, such a canoe is usually fairly inexpensive but, not being a specialized competition craft, fails to inspire the adult boat-lover after its newness has worn off.

From the simple and inexpensive canoe, the would-be sailor looks to a sailing vessel and has to make a choice between keelboats and catamarans (sailboards are akin to surfboards rather than to sailing boats and attract a quite different kind of "afficionado"). Keelboats and catamarans having a cost within the reach of the average buyer—most often a young adult—are almost invariably suited for day-long sailing only, having no cargo stowage space to permit protracted voyages. Examples of such "day out" keelboats are the various sailing dinghies, V.J.'s, Eighteen-foot skiffs and the like. Affordable catamarans include the "Hobie" type, "surf cats", "hydra cats" and the racing catamarans, all of which have no cargo space in their extremely narrow-beamed "plank-on-edge" hulls, which may actually be solid.

From the above it will be realised that a need undoubtedly exists for a deep-water craft which is initially inexpensive and takes the basic form of a boat hull which can be converted from a simply, manually-propelled vessel to a sailboat, and which can be joined to a second such boat hull so as to constitute a catamaran.

The present invention has as an object the fulfilling of this need in a relatively inexpensive and eminently practical manner and thus consists broadly in a demountable catamaran comprising a first kayak-type canoe hull, a second kayak-type canoe hull and a trampoline removably adapted to span and space-apart said hulls: each said hull having a spaced-apart pair of cockpits arranged in tandem; a pair of tabernacles one located forward of and the other located aft of said tandem cockpits, each tabernacle being adapted to receive removably therein an elongated spigot component substantially normally to the water-line of said hull; said trampoline having a rectangular frame provided with four depending elongated spigot components each adapted to be removably received in a said tabernacle; a further tabernacle mounted upon a forward cross-member of said trampoline frame; a mast, the butt-end of which is removably receivable in either (a) said further tabernacle or (b) said forward tabernacle of a said hull; and a sail for said mast.

Preferably, each one of the kayak-type canoe hulls has a pair of water-tight cargo stowage holds, one located forward of and the other located aft of the said pair of tabernacles. Advantageously, each hull may also have a pair of buoyancy compartments, one located forward of and the other located aft of the said pair of cargo stowage holds, each buoyancy compartment being filled with flotation material.

Each hull may well have, located substantially amidships, a fin-box adapted to removably receive therein a keel member, and each hull is preferably provided with a rudder which, when a canoe hull is used singly, is operable from the aft tandem cockpit but which is also capable of being coupled to its neighbouring rudder and operated by tiller means when the vessel is in its catamaran configuration.

Ideally, each of the cargo stowage holds is provided with a screw hatch arrangement at its top centre; and above each hold may be a recessed deck load bay.

In a further aspect, the present invention may consist in a waterborne vessel capable of being operated in any one of three modes, the first mode being as a manually-propelled canoe, the second mode being as a keeled sailing canoe and the third mode being as a catamaran; the waterborne vessel comprising a first moulded fibreglass kayak-type canoe hull, a second moulded fibreglass kayak-type canoe hull and a trampoline adapted to removably span and space-apart the hulls: each hull having a spaced-apart pair of cockpits arranged in tandem; a pair of tabernacles, one located forward of and the other located aft of the tandem cockpits, each tabernacle being adapted to removably receive therein an elongated spigot component, substantially normally to the water-line of the hull; a pair of water-tight cargo stowage holds, one located forward of and the other located aft of the pair of tabernacles, each cargo stowage hold being provided with a screw access hatch arrangement at the top centre thereof, there being a recessed deck load bay above each hold; a pair of buoyancy compartments, one located forward of and the other located aft of the pair of cargo stowage holds, each buoyancy compartment being filled with flotation material; a fin-box adapted to removably receive therein a keel member; and a rudder which, when the vessel is used in the second mode, is operable from the aft tandem cockpit and which is capable of being coupled to its neighbouring rudder and operated by tiller means when the vessel is used in the third mode; said trampoline having a rectangular frame provided with four depending, elongated spigot components each adapted to be removably received in a said tabernacle when the vessel is used in the third mode, a further tabernacle mounted upon a forward cross-member of the trampoline frame; a mast, the butt-end of which constitutes an elongated spigot component and is removable receivable in either the further tabernacle when the vessel is used in the third mode or in a said forward tabernacle of a said hull when the vessel is used in the second mode; and a sail for the mast.

In order that the reader may gain a better understanding of the present invention, hereinafter will be described a preferred embodiment thereof, by way of example only, and with reference to the accompanying drawings in which:

FIG. 1 is a side view of a kayak-type canoe hull;

FIG. 2 is a corresponding deck plan view;

FIG. 3 is a deck plan view of a catamaran configuration of the present invention;

FIG. 4 is a corresponding bow-on view; and

FIGS. 5 to 7 show the three modes of operation of the waterborne vessel according to the present invention.

In these Figures of the drawings, like integers are referenced by the same numerals throughout.

FIGS. 1, 2 and 5 show the basic canoe hull, that is to say, both the first and second kayak-type canoe hulls. This basic kayak-type canoe hull may be a moulded fibreglass, 5.3 meter, tandem-cockpit, turtle-decked canoe of beamy proportions having a maximum beam amidships of perhaps 0.88 meter. FIGS. 1, 2 and also FIG. 6 illustrate the basic canoe hull accoutred to constitute a keeled sailing canoe, while FIGS. 3, 4 and 7 show the mode in which a first and a second moulded fibreglass kayak-type canoe hull may constitute a sailing catamaran.

The drawings show such a kayak-type canoe hull 1 having spaced-apart cockpits 2, 3 arranged in tandem. Located forward and aft of these tandem cockpits 2 and 3 are a pair of "tabernacles", that is to say, sockets in which may be stepped such structures as a mast butt or other elongated spigot component. The illustrated canoe hull is of substantially V-section—to be best seen in FIG. 4—and has sheer fore and aft.

Fore and aft of tabernacles 4 and 5, respectively, are the water-tight cargo stowage holds 6 and 7, each of which is provided with a screw access hatch arrangement 8, 9 at its respective top centre.

Above each cargo stowage hold 6, 7 is a deck load bay, respectively 10, 11, which is recessed into the turtle deck and may be surrounded by a raised coaming or cofferdam, each sufficient to accommodate, say, a 75 liter capacity back-pack when fully loaded or, perhaps, tents and/or other trek equipment. Chainplates 12 are provided on each deck load bay for the securing of deck-borne loads. The watertight cargo stowage holds 6 and 7 are eminently suitable for the stowage of such items as food, drink, clothing, etc., and also sails and rigging for the conversion of manually-propelled canoe to keeled sailing canoe.

At bow and stern of the moulded fibreglass kayak-type canoe hull are buoyancy compartments 13 and 14 (see FIG. 1) when are filled with a recommended flotation material to accord with the International Standard Draft code for canoes and other small craft.

Each cargo stowage hold 6, 7 is fitted with a drain plug, 15 and 16 respectively, while from the bilges, a drain tunnel 17 passes through stern buoyancy compartment 14 to open into an outlet at the sternpost of the craft, this outlet being closable by a plug 18. Each cockpit 2, 3 is equipped with a one-piece moulded fibreglass seat, 19 and 20 respectively, contoured so as to allow the user to assume a relaxed posture while correctly supporting the back and legs in comfort over protracted periods of time. At bow and stern are the anchored-in rope carrying-handles 21 and 22 which enable the vessel to be carried quite easily by two persons, and the craft is light enough to be hefted onto the roof rack of a passenger motor vehicle; there is also a bow-eye 23 to which may be belayed a painter or the like. Substantially amidships on the turtleback deck, a compass binnacle 24 may be mounted between cockpits 2 and 3, and at the stern is a pintle-post for the shipping of a rudder, later to be described herein.

Referring now again to FIGS. 1 and 2 in conjunction with FIG. 6, the basic canoe hull 1 can be seen to be converted into an efficient and seaworthy sailboat. In this mode a 30–40 mm diameter aluminium mast 25 is stepped in forward tabernacle 4 in which it may be secured by a keyway and large set-screw working in a collar, the butt-end of mast 25 constituting an elongated spigot set into the keelson. Mast 25 is stayed by a pair of shrouds 26, 27, and a forestay 28, these being secured to shroud eye-bolts 29, 30 and forestay fitting 31 all of which are bolted to the turtleback deck. The craft is cat-rigged with a single battened sail 32. However, alternative rigs such as, for example, a dipping lugsail, are considered suitable.

Set into a fin-box 33, substantially amidships, is a demountable keel 34 which may be of moulded fibreglass, polyurethane or other suitable material and hung on the stern pintle-post is an aluminium rudder bracket 35 between the bifurcate limbs of which is affixed a rudder 36 of the shape illustrated. Rudder 36 may be of moulded fibreglass, polyurethane or other suitable material and it permits the craft to be brought into the wind very rapidly to prevent the vessel turning turtle in squally conditions. The rudder 36 may be actuated from aft tandem cockpit 2 through the agency of a cross-arm 37 on rudder bracket 35, cables 38 and 39, and foot control 40 in the aft cockpit. Thus, as will be realized, these are somewhat akin to simple basic aircraft controls. When the craft is operated in the keelboat mode, the canoe paddles, such as 41, are stowed in suitable clips affixed in the turtleback deck, these not being shown in FIG. 6 for reasons of clarity. The craft as described above has an exceptionally low centre of gravity to impart great stability while paddling or sailing the craft, and the hull design and geometry also provide stability during entry to and egress from the craft while on the water. The craft has virtually unmatched seaworthiness and safety factors.

Attention is now drawn to FIGS. 3, 4 and 7 which depict an inventive catamaran comprising two basic, moulded fibreglass kayak-type canoe hulls—such as that previously referenced 1—joined parallelly together. This joining together of the hulls is brought about by way of a "trampoline", generally referenced 42, which has a rectangular frame 41' to which is laced the usual "deck" 43. The trampoline frame is provided with four depending, elongated spigot components 42' each adapted to be removably received in one of the four tabernacles of the two hulls, so that the trampoline spans and spaces-apart the hulls, the spigots being secured in the tabernacles by such means as a keyway and a large set-screw working in a collar. The mast previously referenced 25 is, in this mode, stepped in a further tabernacle 44 mounted upon the forward cross-member 45 of the trampoline frame and is stayed by the shrouds 26, 27 and a divided forestay 46. Here again, the sail 32 may be a battened cat-rig sail.

In the catamaran mode, steering is achieved by coupling the rudders 36 through primary tillers 47, 48; coupling link 49 and inboard tiller means 50.

The catamaran configuration is able to handle almost any type of open and closed waters (sea, rivers, lakes, bays etc.). Sail or paddle may be used, depending on conditions. Good vision allows the crew to paddle or sail the craft at a brisk rate even against tides and head winds. The twin keels and the particular shape of the rudders give the crew full control under all sea and river conditions. Two adults are easily able to carry the catamaran by using the side members of the trampoline frame as handholds.

As will be appreciated, the craft of the present invention provides virtually maintenance-free, low cost boating for a sole operator or a small group. Of great advantage is the fact that the craft may be purchased in stages, firstly the basic hull for use as a canoe, then the mast, sail, rigging and rudder, and finally a second hull and trampoline.

From the abovegoing, the reader will realise that craft built in accordance with the present invention provide the public with a new or much-improved article or, at the very least, offer to it a useful and attractive choice.

The claims defining the invention are as follows:

I claim:

1. A demountable catamaran comprising a first kayak-type canoe hull, a second kayak-type canoe hull, a trampoline adapted to removably span and maintain said hulls spaced apart; each said hull having a spaced-apart pair of cockpits arranged in tandem; each said hull including a pair of tabernacles, one located forward of and the other located aft of said tandem cockpits, each said tabernacle being adapted to removably receive therein an elongated spigot component, substantially normally to the water-line of said hull; said trampoline having a rectangular frame provided with four depending, elongated spigot components each adapted to be removably received in a respective one said tabernacle, a further tabernacle mounted upon a forward cross-member of said trampoline frame; a mast, the butt end of which is removably receivable in either said further tabernacle or a forward one said tabernacle of said hull; and a sail for said mast.

2. The demountable catamaran as claimed in claim 1, wherein each kayak-type canoe hull has a pair of water-tight cargo stowage holds, one located forward of and the other located aft of said pair of tabernacles.

3. The demountable catamaran as claimed in claim 1 or claim 2, wherein each kayak-type canoe hull has a pair of buoyancy compartments, one located forward of and the other located aft of said pair of cargo stowage holds, each buoyancy compartment being filled with flotation material.

4. The demountable catamaran as claimed in claim 1, wherein each said kayak-type canoe hull has, located substantially amidships, a fin-box adapted to removably receive therein a keel member.

5. The demountable catamaran as claimed in claim 1, wherein each said kayak-type canoe hull is provided with a rudder which, when a canoe hull is used singly, is operable from the aft tandem cockpit but which is capable of being coupled to its neighbouring rudder and operated by tiller means when the vessel is in its catamaran configuration.

6. The demountable catamaran as claimed in claim 2, wherein each said cargo stowage hold is provided with a screw hatch fitting at its top centre and wherein, above each hold, is a recessed deck load bay.

7. A water-borne vessel capable of being operated in any one of three modes, the first mode being as a manually-propelled canoe, the second mode being as a keeled sailing canoe and the third mode being as a catamaran; said water-borne vessel comprising a first kayak-type canoe hull, a second kayak-type canoe hull and a trampoline adapted to removably span and maintain said hulls spaced apart; each said hull having a spaced-apart pair of cockpits arranged in tandem; a pair of tabernacles, one located forward of and the other located aft of said tandem cockpits, each said tabernacle being adapted to removably receive therein elongated spigot component, substantially normally to the waterline of said hull; a pair of water-tight stowage holds, one located forward of and the other located aft of said pair of tabernacles, each said cargo stowage hold being provided with a hatch cover; a recessed deck load bay above each said hold; a pair of buoyancy compartments, one located forward of and the other located aft of said pair of cargo stowage holds, each said buoyancy compartment being adapted to be filled with flotation material; a fin-box adapted to removably receive therein a keel member; and a rudder which, when the vessel is used in the second mode, is operable from the aft tandem cockpit and which is capable of being coupled to its neighbouring rudder and operated by tiller means when the vessel is used in the third mode; said trampoline having a substantially rectangular frame provided with four depending, elongated spigot components each adapted to be removably received in respective ones of said tabernacles when the vessel is used in the third mode, a further tabernacle mounted upon a forward cross-member of said trampoline frame; a mast, the butt end of which constitutes an elongated spigot component and is removably receivable in either said further tabernacle when said vessel is used in the third mode or in said forward tabernacle of either said hull when the vessel is used in the second mode; and a sail for said mast.

* * * * *